US009004024B2

(12) United States Patent
Heintzen et al.

(10) Patent No.: US 9,004,024 B2
(45) Date of Patent: Apr. 14, 2015

(54) CAM SHAFT ADJUSTER AND METHOD FOR ADJUSTING THE ANGLE-OF-ROTATION POSITION OF A CAM SHAFT RELATIVE TO A CRANKSHAFT

(75) Inventors: Dirk Heintzen, Weisendorf (DE); Matthias Friedrichs, Hamburg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 423 days.

(21) Appl. No.: 13/259,584

(22) PCT Filed: Mar. 16, 2010

(86) PCT No.: PCT/EP2010/053343

§ 371 (c)(1),
(2), (4) Date: Dec. 16, 2011

(87) PCT Pub. No.: WO2010/112329

PCT Pub. Date: Oct. 7, 2010

(65) Prior Publication Data

US 2012/0085304 A1 Apr. 12, 2012

(30) Foreign Application Priority Data

Apr. 1, 2009 (DE) ..... 10 2009 015 882

(51) Int. Cl.
*F01L 1/34* (2006.01)
*F01L 1/344* (2006.01)

(52) U.S. Cl.
CPC ..... *F01L 1/3442* (2013.01); *F01L 2001/34483* (2013.01)

(58) Field of Classification Search
USPC ..... 123/90.12, 90.15, 90.17, 90.33, 90.34; 464/160, 161; 137/625.25, 625.26, 137/625.67, 625.68
See application file for complete search history.

(56) References Cited

U.S. PATENT DOCUMENTS

| | | | | |
|---|---|---|---|---|
| 2007/0144475 | A1 | 6/2007 | Suzuki | |
| 2007/0215084 | A1 * | 9/2007 | Pluta et al. | 123/90.17 |
| 2008/0173267 | A1 * | 7/2008 | Takahashi et al. | 123/90.17 |

FOREIGN PATENT DOCUMENTS

| | | | |
|---|---|---|---|
| DE | 100 84 408 | B4 | 2/2004 |
| EP | 1 849 967 | A2 | 10/2007 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT a cam adjuster for adjusting the angle-of-rotation positions of a cam shaft relative to a crankshaft. The cam shaft adjuster has at least two operating chambers to which pressure oil can be supplied to change the angle-of-rotation position. At least one of the operating chambers can be deactivated depending on an operating parameter by blocking the pressure oil supply.

10 Claims, 6 Drawing Sheets

CAM SHAFT ADJUSTER AND METHOD FOR ADJUSTING THE ANGLE-OF-ROTATION POSITION OF A CAM SHAFT RELATIVE TO A CRANKSHAFT

CROSS-REFERENCE TO RELATED APPLICATIONS

This applications is a 371 of PCT/EP2010/053343 filed Mar. 16, 2010, which in turn claims the priority of DE 10 2009 015 882.0 filed Apr. 1, 2009. The priority of both applications is hereby claimed and both applications are incorporated by reference herein.

FIELD OF THE INVENTION

The invention relates to a camshaft adjuster. Furthermore, the invention relates to a method for adjusting the angle-of-rotation position of a camshaft relative to a crankshaft for an internal combustion engine.

BACKGROUND OF THE INVENTION

DE 100 84 408 B4 discloses a camshaft adjuster of vane cell design, the driving clement of which, in the form of a driving toothed wheel, is driven by a crankshaft via a traction element, such as a chain or a belt. A "stator," in which a rotor is arranged rotatably in order to produce an actuating angle, is connected to the driving wheel for rotation therewith. The rotor is connected to a camshaft for rotation therewith. A relative angular position between the camshaft and driving wheel, and therefore the crankshaft, can be influenced according to the actuating angle, this being associated with a change in the engine timings. In an embodiment of vane cell design, the rotor has vanes which are displaceable in the circumferential direction, depending on a hydraulic pressure in control chambers of the stator, in order to produce an actuating angle. On the side facing away from the camshaft, the stator is formed by a disk which delimits the control chambers in the axial direction. The ratios of force between the rotor and stator can influenced, in addition to the hydraulic ratios in the region of the vanes, by a torsion spring, the base points of which are supported on the stator and on the rotor. The torsion spring is arranged on that side of the disk which faces away from the rotor, with a plurality of turns about the longitudinal axis. The radially outer base point is supported in relation to the stator via screws which serve at the same time to fasten the disk in the stator. The radially inner base point of the torsion spring is bent in a U-shaped manner and engages in a form-fitting manner around a rectangular partial cross-section of a supporting element. The supporting element furthermore has a cylindrical extension with which said supporting element extends through a central bore in the disk so as to permit relative rotation. The extension is connected in the stator to the camshaft for rotation therewith, in particular via an end side of the rotor.

A pin which is referred to in the document as a locking pin is guided displaceably in a bore of the rotor parallel to the longitudinal axis of the camshaft adjuster, wherein the axial position of the pin can be influenced by the ratios of force of a compression spring and/or the hydraulic ratios in the region of end surfaces of the pin. The disk of the stator has a corresponding recess which is oriented in the axial direction and is in the form of a blind hole. For an activated position of the pin, in particular a starting position, intermediate position, central position, advanced or retarded position, the pin emerges with an end region out of the rotor and enters the recess of the disk of the stator such that the degree of freedom of rotation between the rotor and stator is limited.

OBJECT OF THE INVENTION

The present invention is based on the object of providing a camshaft adjuster which requires particularly little oil. It is a further object of the invention to provide a corresponding method for adjusting the angle-of-rotation position of a camshaft relative to a crankshaft.

SUMMARY OF THE INVENTION

According to the invention, the object directed towards a camshaft adjuster is achieved by the provision of a camshaft adjuster for adjusting the angle-of-rotation position of a camshaft relative to a crankshaft, with at least two working chambers to which pressure oil can be supplied to change the angle-of-rotation position, wherein at least one of the working chambers can be cut off depending on an operating parameter by the supply of pressure oil being blocked.

The invention is based on the finding that the pressure transmission ratio, which is at the basis of the torque, which is imparted by the pressure oil, for rotating the camshaft, is decisively determined by ratios at a low pressure. The pressure transmission ratio of a camshaft adjuster is selected in such a manner that reliable adjustment is still possible even at a low engine oil pressure. The pressure transmission ratio follows here from the size and number of the working chambers and the size of the operative surfaces of the actuating elements, i.e. the vane surfaces in the case of a vane cell adjuster. As the engine oil pressure rises, a higher actuating torque therefore occurs. In this case, the actuating torque exceeds a value which would actually be sufficient for reliable and sufficiently rapid adjustment. Therefore, by definition of the requirement at low oil pressure, resources are given away at a higher oil pressure. In particular, it is endeavored to configure the oil pump of an internal combustion engine to be as small as possible, this being limited by the requirement of the oil consumers. A lower oil requirement in the adjustment of a camshaft would therefore be advantageous.

The invention now achieves this by at least one of the working chambers of the camshaft adjuster being configured so as to be able to be cut off. That is to say, depending on an operating parameter, in particular the oil pressure, the supply of oil to one of the working chambers is prevented and, as a result, the oil requirement is reduced. In an operating state in which the torque provided for adjusting the camshaft is sufficient even without said working chamber, the reduction of the quantity of oil does not result in any impairment of the operation.

The camshaft adjuster is advantageously of vane cell design, each working chamber being divided by a respective vane into two sub chambers, and the pressure oil being supplied to one of the two chambers, depending on the desired direction of the change in the angle-of-rotation position, in such a manner that said sub chamber is increased and the second sub chamber is reduced. Owing to the fact that a vane cell adjuster is in any case divided into a plurality of working chambers, this construction is particularly suitable for being adapted to an operating state because of the possibility of cutting off a working chamber.

The supply of pressure oil can preferably be blocked by an actuating body, the actuating position of which is determined by the pressure of the pressure oil. The actuating body furthermore preferably has a resetting spring, the spring force of which is directed counter to the actuating effect of the pressure oil. This configuration results in a particularly simple mechanism for cutting off the working chamber. The rising pressure of the pressure oil acts here directly on the actuating body in such a manner that, from a certain pressure, said actuating body prevents the supply of pressure oil to the working chamber. The resetting force of a spring serves to set the cut-off value for the pressure.

Preferably, when the working chamber is cut off, a short-circuiting pressure oil connection is produced at the same time between the two sub chambers of said working chamber. This ensures that the cut-off working chamber does not cause any impermissible delay in the adjusting operation because of the oil which continues to remain therein. The short-circuiting pressure oil connection permits the movement of the actuating element, driven by the other working chambers which remain active, within the cut-off working chamber. In this case, the actuating element displaces oil via the short-circuit between the two sub chambers of the working chamber without being impermissibly severely braked as a result. The cutting off of the working chamber and the short-circuit of the pressure oil are furthermore preferably brought about simultaneously by an actuating body.

Preferably, at least two working chambers can be cut off, the first working chamber being able to be cut off at a first value of the operating parameter, and the second working chamber being able to be cut off at a second value of the operating parameter, which value is greater than the first value. By means of this configuration, it is possible to even more finely adapt the oil required to the particular operating state. As the pressure rises and therefore the torque available for the adjustment operation also rises, first of all a first working chamber and then a second chamber or even further chambers can be cut off. When the cut-off mechanism is configured as described above with the actuating body and resetting spring, this gradual adaptation can be realized in a simple manner by a dedicated cut-off mechanism having a resetting spring of respectively differing strength being provided for each working chamber.

The actuating body is preferably of double-action design in such a manner that, depending on the direction of the change in the angle-of-rotation position, the working chamber can be cut off by the supply of pressure oil either to the first or second sub chamber being blocked. A mechanism is therefore provided by means of which both the first and the second sub chamber can be cut off. It is therefore possible to use a single cut-off mechanism for both possible actuating directions to cut off the working chamber.

A locking mechanism is preferably provided, by means of which an adjustment of the angle-of-rotation position can be blocked, wherein the blocking of the supply of pressure oil can also be set by the locking mechanism. Furthermore preferably, at a first oil pressure, the locking mechanism releases the supply of pressure oil counter to the force of a first spring and, at a second, higher oil pressure, blocks the supply of pressure oil counter to the force of a second spring. Therefore, both locking of the adjuster and cutting off of the working chamber are brought about by a single mechanism.

According to the invention, the object directed towards a method is achieved by provision of a method for adjusting the angle-of-rotation position of a camshaft relative to a crankshaft, in which pressure oil can be supplied into the working chambers of a camshaft adjuster having at least two working chambers to change the angle-of-rotation position, wherein the supply of pressure oil to at least one of the working chambers is blocked if a predetermined pressure of the pressure oil is exceeded, while the supply of pressure oil to at least one of the remaining working chambers remains open.

The advantages of a method of this type correspond to the advantages of the camshaft adjuster described above.

BRIEF DESCRIPTION OF THE DRAWINGS

The invention is explained in more detail by way of example with reference to the drawing, in which.

DETAILED DESCRIPTION OF THE INVENTION

Figure 1:
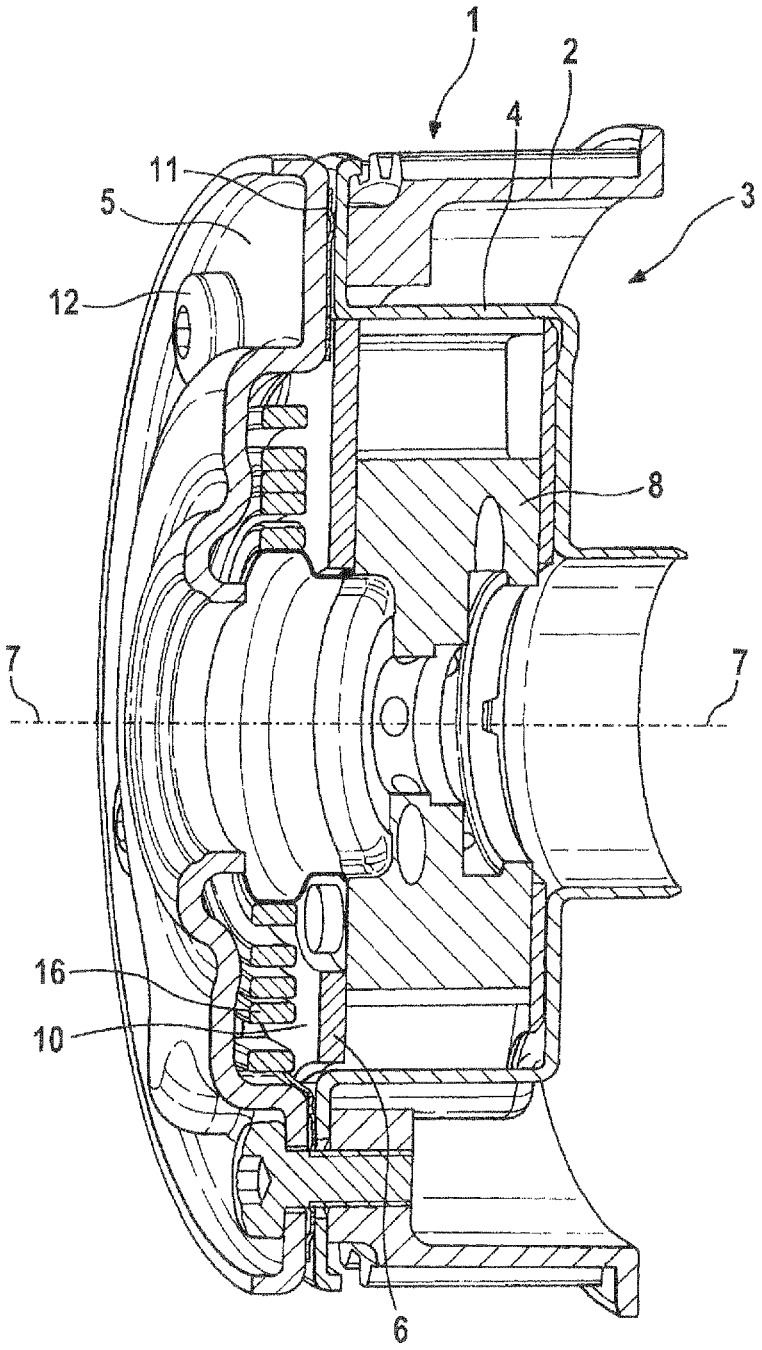
FIG. 1 shows a three-dimensional illustration of a half-longitudinal section of a camshaft adjuster.

FIG. 1 shows a camshaft adjuster 1. The camshaft adjuster 1 is by way of example a camshaft adjuster of vane cell design, although, in principle, any other type of camshaft adjuster, in which the adjustment takes place via the supply of pressure medium into a plurality of working chambers, can be used.

The camshaft adjuster 1 has a driving wheel 2 via which said camshaft adjuster is connected in terms of drive to a crankshaft. The driving wheel 2 is connected to a stator 3 for rotation therewith, the stator being formed with a pot-shaped housing 4 and a housing cover 5. The interior, which is delimited by the housing 4 and housing cover 5, is divided into two sub spaces located axially next to each other via a circular-ring-shaped disk 6 which is oriented transversely with respect to a longitudinal axis 7-7 of the camshaft adjuster 1. The sub space facing the camshaft accommodates, in a manner not illustrated and with the formation of control chambers, the rotor 8 which has vanes and which is connected or braced to a threaded bore on the end side of the camshaft with the use of a central screw (not illustrated). A torsion spring 16 which extends with multiple turns about the longitudinal axis 7-7 is connected in between the stator 3 and rotor 8. The sub space arranged on that side of the disk 6 which faces away from the camshaft forms an annular space 10 encircling around the longitudinal axis 7-7. The annular space 10 is sealed in the contact region between the housing 4 of the stator 3 and housing cover 5 by the interconnection of a sealing plate 11 which can be braced between the housing 4 and housing cover 5 by fastening screws 12 being tightened.

Figure 2:
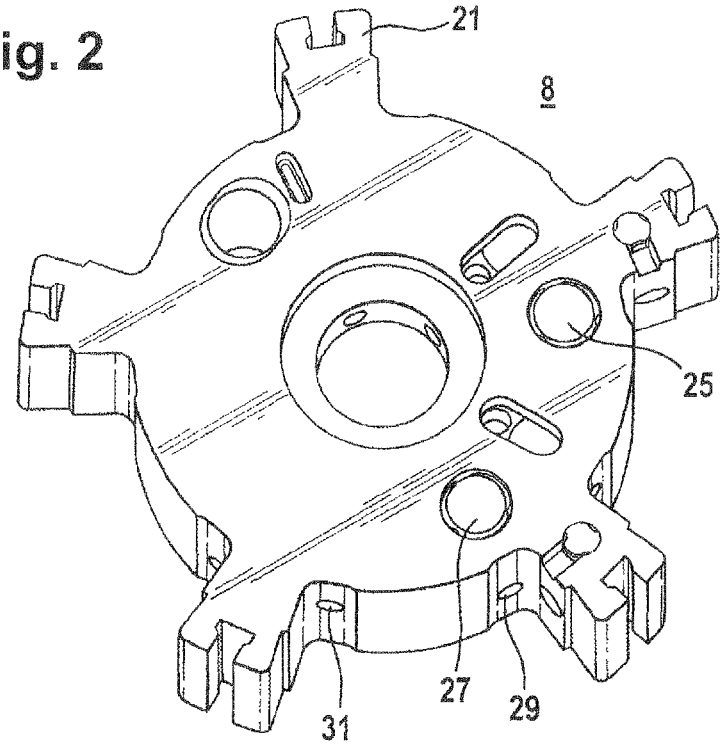
FIG. 2 shows a rotor of a camshaft adjuster.

FIG. 2 shows the rotor 8 of a camshaft adjuster 1. The outer circumference of the rotor 8 has five vanes 21. Each of said vanes 21 is arranged in a working chamber 41 (not illustrated specifically here), said working chambers being formed by the stator 2 (not illustrated) and the rotor 8. A vane 21 divides the particular working chamber thereof into two sub chambers 41A, 41B. The working and sub chambers are illustrated schematically further on in FIG. 4. Each sub chamber 41A, 41B can be supplied with oil by an oil duct 29, 31 or can be emptied via said oil duct 29, 31. In order to adjust the camshaft in a first actuating direction, oil is supplied for this purpose, for example, to each sub chamber 41A on the left of a vane 21, while the other sub chamber 41B in each case is opened towards the tank and emptied. In the reverse, second actuating direction, the supply and removal of oil take place the other way around. In this case, the oil is supplied to and removed from the camshaft via the rotor hub. In the view in FIG. 2, a first cut-off mechanism 25 and a second cut-off mechanism 27 can be seen. Said cut-off mechanisms 25, 27 are each connected upstream of the oil duct 29, 31 of a sub chamber 41A, 41B. Corresponding cut-off mechanisms which act for the other actuating direction, are provided on the opposite side (not visible) of the rotor. The function of the cut-off mechanisms 25, 27 is described in more detail with reference to FIG. 3.

Figure 3:
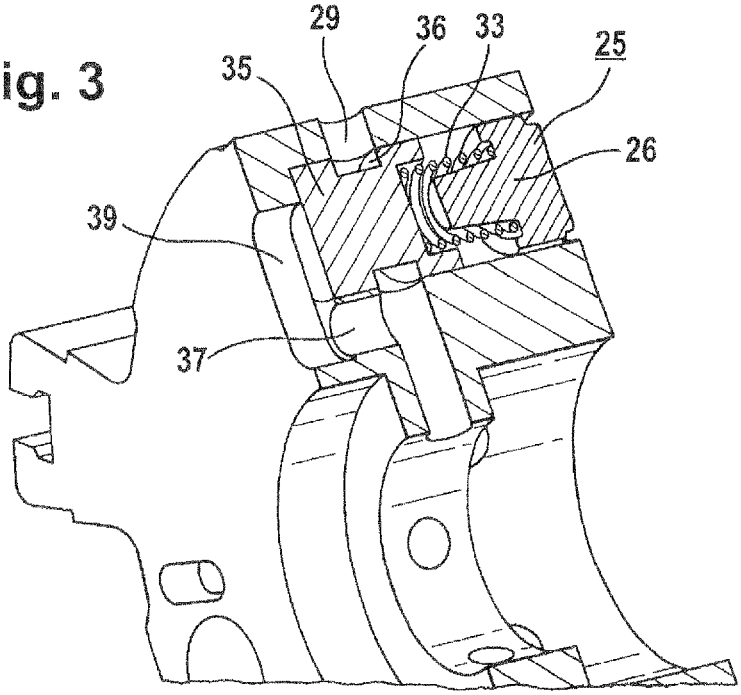
FIG. 3 shows a three-dimensional illustration of a cross-section through a rotor of a camshaft adjuster.

It becomes clear in FIG. 3 in the cross-section through the rotor from FIG. 2 how a cut-off mechanism is advantageously constructed. An actuating body 35 is pressed into a basic position by means of a spring 33, which sits on a spring support 26, and, by means of an annular groove 36 arranged in the surface of the actuating body, opens up the oil duct 29 to supply oil to a sub chamber 41A. A bypass 37 branches off here from the oil duct 29 and opens out into a recess 39. The actuating body 35 is adjacent to said recess 39. When pressure oil is supplied via the oil duct 29, a force is therefore also exerted on the actuating body 35, said force being directed counter to the spring force of the spring 33. As the pressure rises, the actuating body 35 is displaced counter to the spring force and, in the process, by displacement of the opening annular groove 36, gradually closes the oil duct 29 until, finally, the supply of oil is cut and the working chamber 41 is therefore cut off. The value for the oil pressure at which the cutting off takes place can be set in a simple manner by selecting the spring constants of the spring 33. According to the configuration in FIG. 2, two working chambers can thereby be cut off. In this case, the spring constant of the first cut-off mechanism 25 is selected to be smaller than the spring constant of the otherwise structurally identical second cut-off mechanism 27. A graduated cutting off of the two working chambers thereby occurs: at a first, lower oil pressure, the first working chamber 41 cuts off while, at a second, higher oil pressure, the second working chamber 41 is additionally cut off. The oil requirement can thereby be set in a manner adapted to the operating state.

Figure 4:
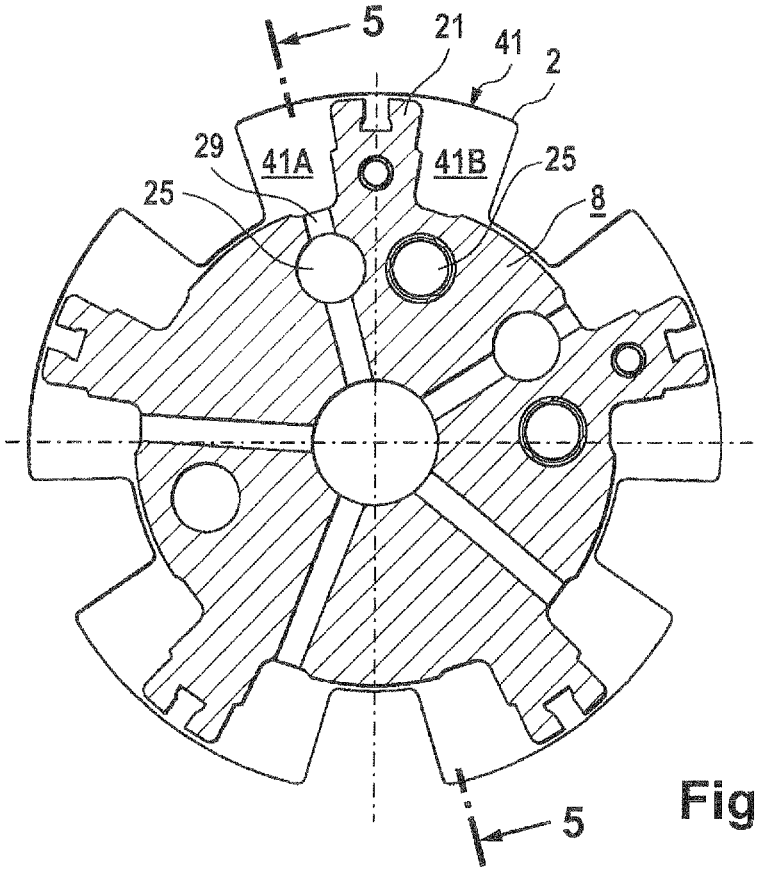
FIG. 4 shows a longitudinal section through a rotor of a camshaft adjuster.
Figure 5:
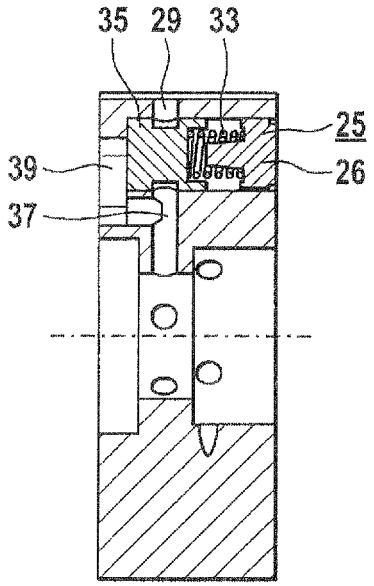
FIG. 5 shows a cross-section through a rotor of a camshaft adjuster with a cut-off mechanism.

It can be seen in FIG. 4 how respective cut-off mechanisms 25 for sub chambers 41A, 41B are respectively arranged on the front side and on the rear side of the rotor 8 according to the particular actuating direction. The arrangement of the cut-off mechanism as described above is illustrated once again in a cross-section in FIG. 5.

Figure 6A:
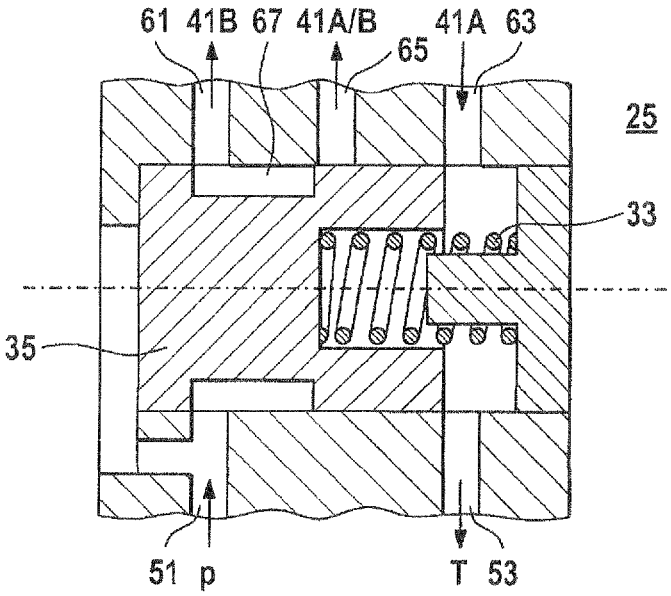
FIG. 6A shows a cut-off mechanism with a short-circuit effect for the sub chambers.
Figure 6B:
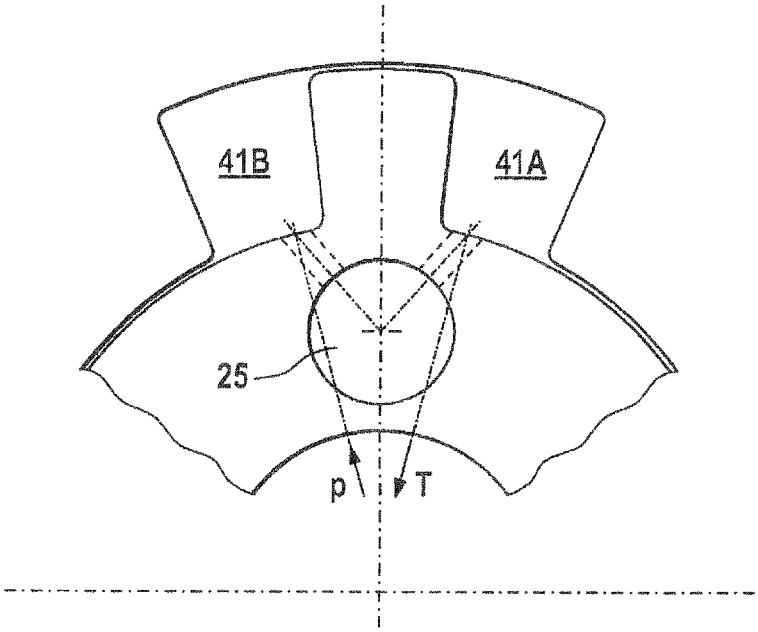
FIG. 6B shows a schematic illustration for cutting off a working chamber by means of the cut-off device according to FIG. 6A in the cut-off position.

FIG. 6A shows a further configuration of the cut-off mechanism in a cross-section, wherein here, as illustrated schematically in FIG. 6B, only a single cut-off mechanism is provided for both sub chambers 41A, 41B. In this case, the actuating body 35 has an annular groove 67 in such a manner that, upon displacement of the actuating body 35 by increasing oil pressure, the supply of oil from an oil duct 51 is cut and at the same time a short-circuit line 65, which connects the two sub chambers 41A, 41B to each other in terms of flow, is opened. By this means, the working chamber 41 is cut off, but at the same time, in spite of the lack of flow of oil out of the working chamber, the vane 21 is prevented from being hydraulically fixed. An adjustment via the action of the other working chambers 41 continues to be possible since the oil in the cut-off working chamber 41 can be displaced from one sub chamber 41A, 4113 into the other sub chamber 41A, 41B via the short-circuit connection 65.

Figure 7A:
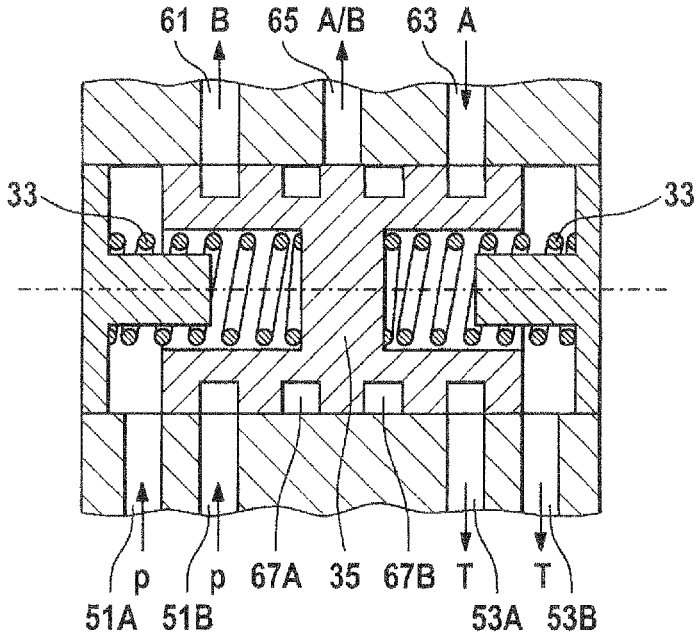
FIG. 7A shows a double-action cut-off mechanism with a short-circuit effect for the sub chambers.
Figure 7B:
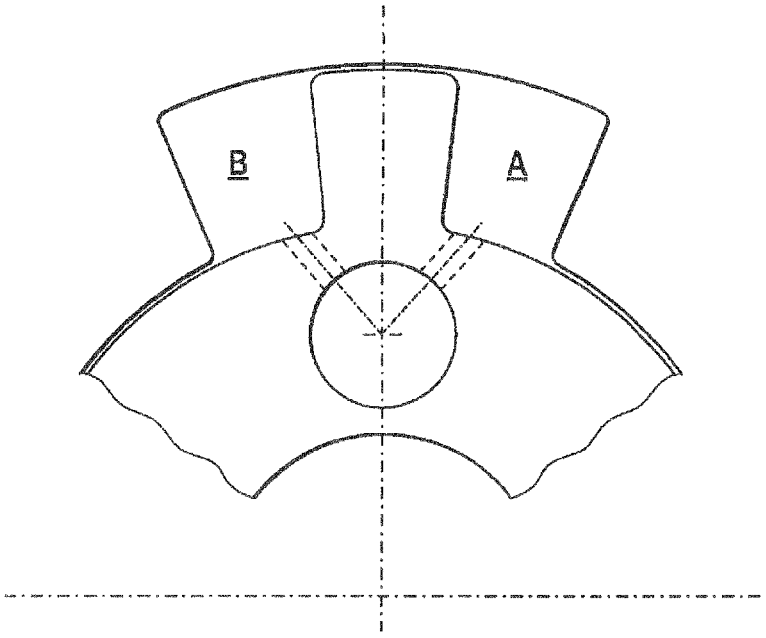
FIG. 7B shows a schematic illustration for cutting off a working chamber by means of the cut-off device according to FIG. 7A in the cut-off position.
Figure 7C:
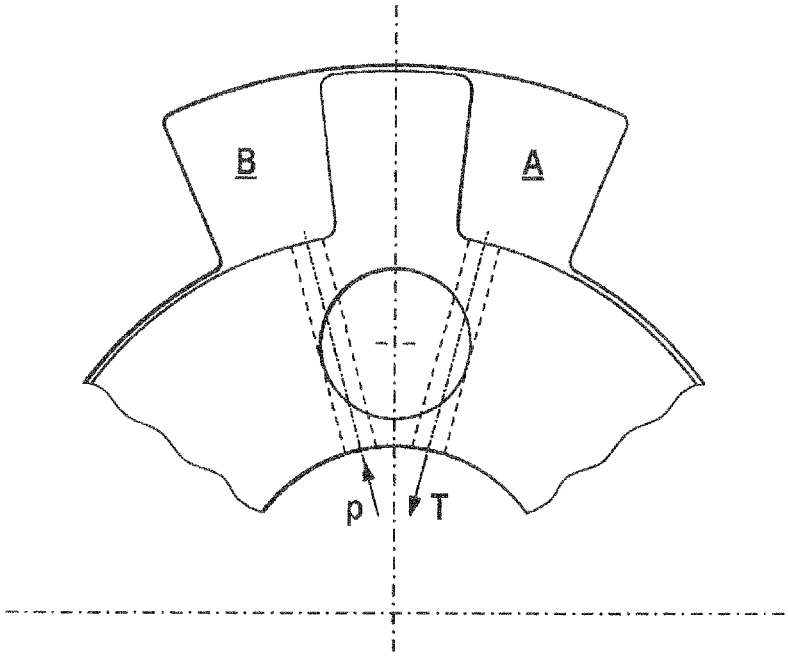
FIG. 7C shows a schematic illustration for cutting off a working chamber by means of the cut-off device according to FIG. 7A in the working position.

The cut-off mechanism in FIG. 6A is advantageously of double-action design such that cutting off is possible for both actuating directions. This is illustrated in FIG. 7A, The actuating body is now arranged between two springs 33 and has a plurality of grooves 67A, 67B in such a manner that the supply of oil firstly to the sub chamber 41A and the next time to the sub chamber 41 B is blocked in both directions of displacement, wherein, in both cases, a short-circuit connection 65 between the sub chambers 41A, 41B is set by the blocking of the supply of oil and therefore the cutting off of the working chamber 41. The switching state "working chamber in operation" is shown schematically in FIG. 7C and the switching state "working chamber cut off" is shown schematically in FIG. 7B.

Figure 8:
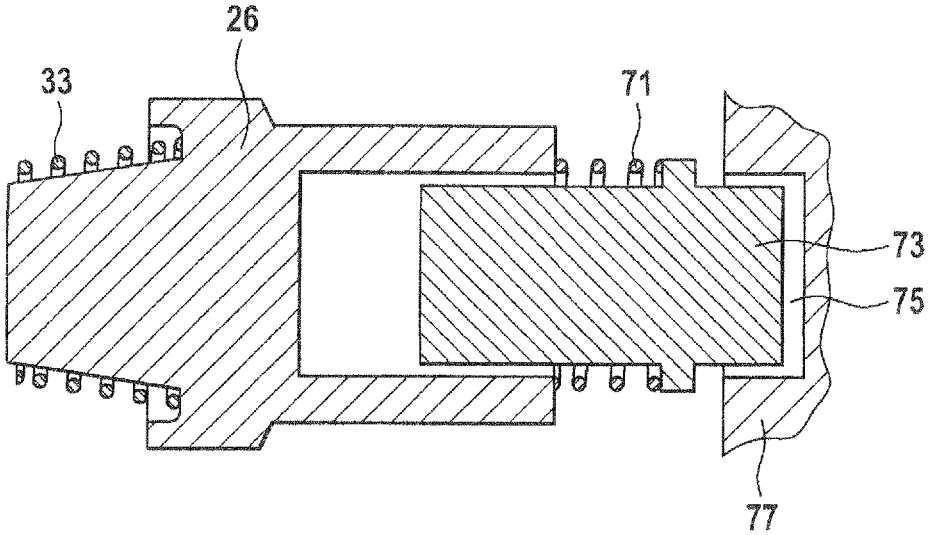
FIG. 8 shows a cut-off mechanism which is designed at the same time as a locking mechanism.

Finally, FIG. 8 shows a further configuration of a cut-off mechanism 25, wherein only part of the spring 33 and of the spring support 26 are shown. A locking pin 73 is in engagement with the spring support 26 and, at a first oil pressure, is released counter to the spring force of a locking spring 71 from a slotted locking link 75 arranged in a side cover 77, and therefore opens up the camshaft adjuster for an adjustment. As the oil pressure rises further, the cutting off of a working chamber 41 follows as in the manner described above. The cut-off mechanism 25 is therefore connected in a simple manner structurally to a locking mechanism.

LIST OF REFERENCE NUMBERS

1 Camshaft Adjuster
2 Driving Wheel
3 Stator
4 Housing
5 Housing Cover
6 Disk
7 Longitudinal Axis
8 Rotor
10 Annular Space
11 Sealing Plate
12 Fastening Screw
21 Vane
25 Cut-Off Mechanism
26 Spring Support
27 Cut-Off Mechanism
29 Oil Duct
31 Oil Duct
33 Spring
35 Actuating Body
37 Bypass Duct
39 Recess
41 Working Chamber
41A Sub Chamber
41B Sub Chamber
51, 53 Inflow/Outflow
61, 63 Chamber Inflow/Outflow
67 Annular Groove
67A Annular Groove
67B Annular Groove
65 Short-Circuit Duct
71 Locking Spring
73 Locking Pin
75 Slotted Locking Link
77 Side Cover

The invention claimed is:

1. A camshaft adjuster for adjusting an angle-of-rotation position of a camshaft relative to a crankshaft, comprising:

at least two working chambers to which pressure oil can be supplied to change the angle-of-rotation position the at least two working chambers including a first working chamber and a second working chamber, and at least one cut-off mechanism configured to cut-off the first working chamber when a pressure of the pressure oil exceeds a first predetermined value by the supply of pressure oil being blocked and configured to cut-off the second working chamber when a pressure of the pressure oil exceed a second predetermined value greater than the first predetermined by the supply of pressure oil being blocked.

2. The camshaft adjuster as claimed in claim 1, wherein the camshaft adjuster is vane cell, each working chamber is divided by a vane into a first sub-chamber and a second sub-chamber, and the pressure oil is supplied to one of the two sub-chambers, depending on a desired direction of change in the angle-of-rotation position, in such a manner that the one of the sub-chamber is increased and the other of the sub-chamber is reduced.

3. The camshaft adjuster as claimed in claim 2, wherein the at least one cut-off mechanism includes an actuating body for blocking the supply of pressure oil, the actuating body having an actuating position determined by the pressure of the pressure oil.

4. The camshaft adjuster as claimed in claim 3, wherein the actuating body has a resetting spring with a spring force directed counter to an actuating effect of the pressure oil.

5. The camshaft adjuster as claimed in claim 3, wherein, when the at least one working chamber is cut-off, a short-circuiting pressure oil connection is simultaneously produced between the two sub-chambers of the at least one working chamber.

6. The camshaft adjuster as claimed in claim 5, wherein cutting-off of the at least one working chamber and the short-circuit of the pressure oil can occur simultaneously by the actuating body.

7. The camshaft adjuster as claimed in claim 3, wherein the actuating body is of double-action design in such a manner that, depending on a direction of change in the angle-of-rotation position, the at least one working chamber can be cut-off by the supply of pressure oil either to the first sub-chamber or to the second sub-chamber being blocked.

8. The camshaft adjuster as claimed in claim 1, further comprising a locking mechanism, which can block the angle-of-rotation position, and the supply of pressure oil.

9. A camshaft adjuster for adjusting an angle-of-rotation position of a camshaft relative to a crankshaft, comprising:

at lest two working chambers to which pressure oil can be supplied to change the angle-of-rotation position, wherein at least one of the working chambers can be cut-off depending on an operating parameter by the supply of pressure oil being blocked, a locking mechanism, which can block the angel-of-rotation position, and the supply of pressure oil, and a first spring and a second spring, wherein, at a first oil pressure, the locking mechanism release the supply of pressure oil counter to a force of the first spring and, at a second, hight oil pressure, the locking mechanism blocks the supply of pressure oil counter to the force of the second spring.

10. A method for adjusting an angle-of-rotation position of a camshaft relative to a crankshaft, the method comprising the step of:

supplying at least two working chambers of a camshaft adjuster with pressure oil to change the angle-of-rotation position, the at least two working chambers including a first working chamber and a second working chamber;

blocking the supply of pressure oil to the first working chamber when a first predetermined pressure of the pressure oil is exceeded, while the supply of pressure oil to at least one of the remaining working chambers remains open; and blocking the supply of pressure oil to the second working chamber when a second predetermined pressure of the pressure oil greater than the first predetermined pressure is exceeded.

* * * * *